US005495696A

United States Patent [19]

Repka

[11] Patent Number: 5,495,696

[45] Date of Patent: Mar. 5, 1996

[54] FOUNDATION DRAINAGE SYSTEM

[75] Inventor: Raymond R. Repka, Lancaster, N.Y.

[73] Assignee: Kent R. Repka, Lancaster, N.Y.

[21] Appl. No.: 296,033

[22] Filed: Aug. 25, 1994

[51] Int. Cl.[6] ..... F02B 11/00; F02D 19/00

[52] U.S. Cl. ..... 52/169.5; 52/169.14; 405/36; 405/229

[58] Field of Search ..... 52/169.5, 169.14; 405/36, 38, 43, 44, 45, 46, 47, 48, 49, 229; 210/170

[56] References Cited

U.S. PATENT DOCUMENTS 373,946 11/1887 Richardson ..... 52/169.5

4,538,386 9/1985 DiCello ..... 52/169.5

4,563,842 1/1986 Lewis ..... 52/169.5

5,017,042 5/1991 Minor et al. ..... 405/45

*Primary Examiner*—Michael Safavi

*Attorney, Agent, or Firm*—James J. Ralabate

[57] ABSTRACT

A unique water drain system is utilized for eliminating subgrade water which usually accumulates below ground level and causes cracks or leaks in the concrete foundation. The present system is uniquely designed to be used with permanent wood foundations. A basket-retainer is used to contain and prevent the spread of crushed stone out of position. The crushed stone allows the water to flow through it and to a drain tile. The retainer has a water-permeable membrane around or lined in it to prevent soil or debris from clogging up the crushed stone conduit.

8 Claims, 5 Drawing Sheets

FOUNDATION DRAINAGE SYSTEM

This invention relates to permanent foundations for buildings and, more specifically, to a novel foundation water drainage system.

BACKGROUND OF THE INVENTION

It is known in the building trade to use various types of below grade foundations for houses, parking garages, office buildings, hospitals, hotels and the like. Included in these foundations are poured concrete foundations, cinder block foundations and permanent wood foundations. Conventional block or poured concrete footers and walls form a solid mass impeding water flow from below-grade sources entering the interior of the building, i.e. such as cellars of homes, etc. Ground water therefore accumulates against the foundation in voids left from ground water which accumulates both during and after construction. This water could easily cause cracks in the foundation walls during freezing and thawing which eventually causes cracks and moisture problems in the cellar. Mildew forms because water accumulates causing humidity and odor problems in the interior of the structure.

There are a number of systems or structures that have been proposed for reducing or treating water accumulation along building structures such as those disclosed in U.S. Pat. Nos. 3,871,140; 4,523,875; 4,574,541; 4,612,742; 5,056,281; 5,120,162; 5,158,501; 5,228,805 and 5,248,225. None of these systems provides the desirable results of the present invention.

To minimize water problems, builders and engineers have suggested the use of porous crushed stone which permits below-grade water to flow through the stone, which acts as a storm drain. This expedient has been somewhat successful but not totally, because the crushed stone aggregate has a tendency to spread when being dumped into the excavation. Of course, once the stone has spread out of its intended position, its effectiveness is greatly diminished.

As earlier noted, an alternative to poured concrete foundations are permanent wood foundations using treated wood products. While more than 400,000 permanent wood foundations have been used in structures since the system was introduced in the early 1970's, it also has not received total acceptance in the building trade. Fear of the durability of treated wood foundations, the strength of such foundations, leaching, water destruction, etc. are some of the major concerns. While most of these concerns are unfounded and based upon improper usage of treated wood foundations, there is no doubt that their usage needs careful review and improvement. Therefore, while permanent wood foundations are not recommended for all uses, they can be used in frame construction where their use is superior to poured concrete. Engineered plywood foundations properly installed, for example, can be less expensive, more energy efficient, easier to install and more crack resistant and durable than concrete foundations. Thus, Permanent Wood Foundation (PWF) is an increasingly popular alternative to poured concrete and concrete block foundations. The PWF is especially attractive for homes with basements because the wood frame construction converts below-grade living spaces as warm and odor-free as the upstairs rooms. Use of PWF is similar to conventional wood-frame walls with one exception. PWF plywood and lumber is impregnated with preservatives to protect the foundation from termites and decay. As Permanent Wood Foundations have gained in use and popularity around the country, some have attempted to cast doubts about the system's benefits and quality. As earlier noted, most of these concerns are either unfounded or based upon mis-use of PWF construction.

Therefore, properly used PWFs and porous, crushed stone with an appropriate drainage system could greatly enhance their usage in the building industry.

SUMMARY OF THE INVENTION

It is therefore an object of this invention to use a foundation drainage system utilizing PWF and crushed stone devoid of the above-noted disadvantages.

Another object of this invention is to provide a novel foundation drainage system that very effectively controls below-grade water and minimizes foundation water and moisture problems.

Yet another object of this invention is to provide a foundation drainage system that is cost effective and more energy efficient than previously used systems.

A further object of this invention is to provide a system that allows previously suspect wood foundations to be successfully used in the building trade.

Yet a further object of this invention is to provide a drainage system that is easy to install and will provide extended protection against wall cracks and moisture problems.

Still another object of this invention is to provide a novel foundation drainage system that permits foundation water to flow to a drain rather than accumulate against the foundation wall avoiding a danger of hydrostatic pressure.

Still a further object of this invention is to provide a foundation system that will minimize entrance of unwanted gases such as radon and the like.

A further object of this invention is to provide a foundation system that prevents sand and silt from entering any crushed stone used.

Also another object of this invention is to provide a drain system used in foundations where spreading of porous crushed stone is prevented, thus maximizing the effectiveness of the stone base.

These and other important objectives of this invention are accomplished, generally speaking, by a foundation drainage system using a wire mesh or any other porous stone retainer which holds the crushed stone in position to prevent voids and spreading. The retainer can be made of metal, fiberglass, plastic or any other suitable material. Lining said retainer is a geotextile material or fabric that prevents sand and silt from entering the crushed stone aggregate mixture within the retainer. The retainer has an L or U-shape configuration so that a portion extends upwardly parallel with the permanent wood foundation and a portion extends beyond the footer plate and confines the crushed stone and would enclose the drain tile or other suitable drain means such as HYDRAWAY structures later discussed. It is preferred, however, that the retainer together with the other components of the present drain system be used to provide maximum drainage. These HYDRAWAY structures can conduct and handle huge amounts of water in the present drainage system. Around the drain tile or other means and in the upward or vertical retainer is also housed the crushed stone. The geotextile fabric is an earth stabilizer and can be any suitable material that effectively prevents sand and silt from entering the crushed stone aggregate. A typical geotextile material is a polypropylene fabric, for example, style no. 3201 made and distributed by Haynes Co. and by Typar Geotextiles (of Rumay) of Old Hickory, Tenn. 37138. The plywood sheathing is vertically placed at a right angle on a footing with a suitable waterproofing material on the outside surface of the plywood and around the top and side portion of the horizontally-positioned footing. A rigid foam insulation is used together with or in place of the waterproofing sheeting, thereby with the waterproofing sheeting, protecting the plywood sheathing. An inside wall is positioned parallel with and in spaced relationship to the plywood sheathing with studs with or without fiberglass insulation therebetween. The inside wall may be any suitable material such as drywall, panelling and the like. The U-shaped retainer is constructed of a strong, wire mesh or,other suitable porous structured retainer as above noted and is lined throughout with any suitable material that will prevent sand and silt from entering into the crushed stone as was earlier mentioned. In place of or together with the vertical portion of the retainer, a structure known as Hydraway Subsurface Geocomposite may be used. HYDRAWAY is a registered trademark of Monsanto Company. At this location HYDRAWAY 300 may be used and in place of or together with a drain tile, HYDRAWAY 2000 may be used. The location where the plywood sheathing contacts the footing is a critical problem area where moisture could accumulate and cause water-caused decomposition and damage. The HYDRAWAY materials above noted can be extended through and over the area where the plywood meets the footing to further protect this location from water damage. Further information on HYDRAWAY is available in a publication, MCHW-2001®, Copyright Monsanto Company. The footing used can be any conventional footing material such as wood, cement, etc. or can be the preferred TRIMAX lumber available from Trimax of Long Island, Inc., 2076 Fifth Avenue, Ronkonkoma, N.Y. 11779. This Trimax Plastic Lumber is much more water resistant than other products and will outlast other footing materials. TRIMAX is a trademark owned by Trimax of Long Island.

DESCRIPTION OF THE DRAWING AND THE PREFERRED EMBODIMENT

Figure 1:
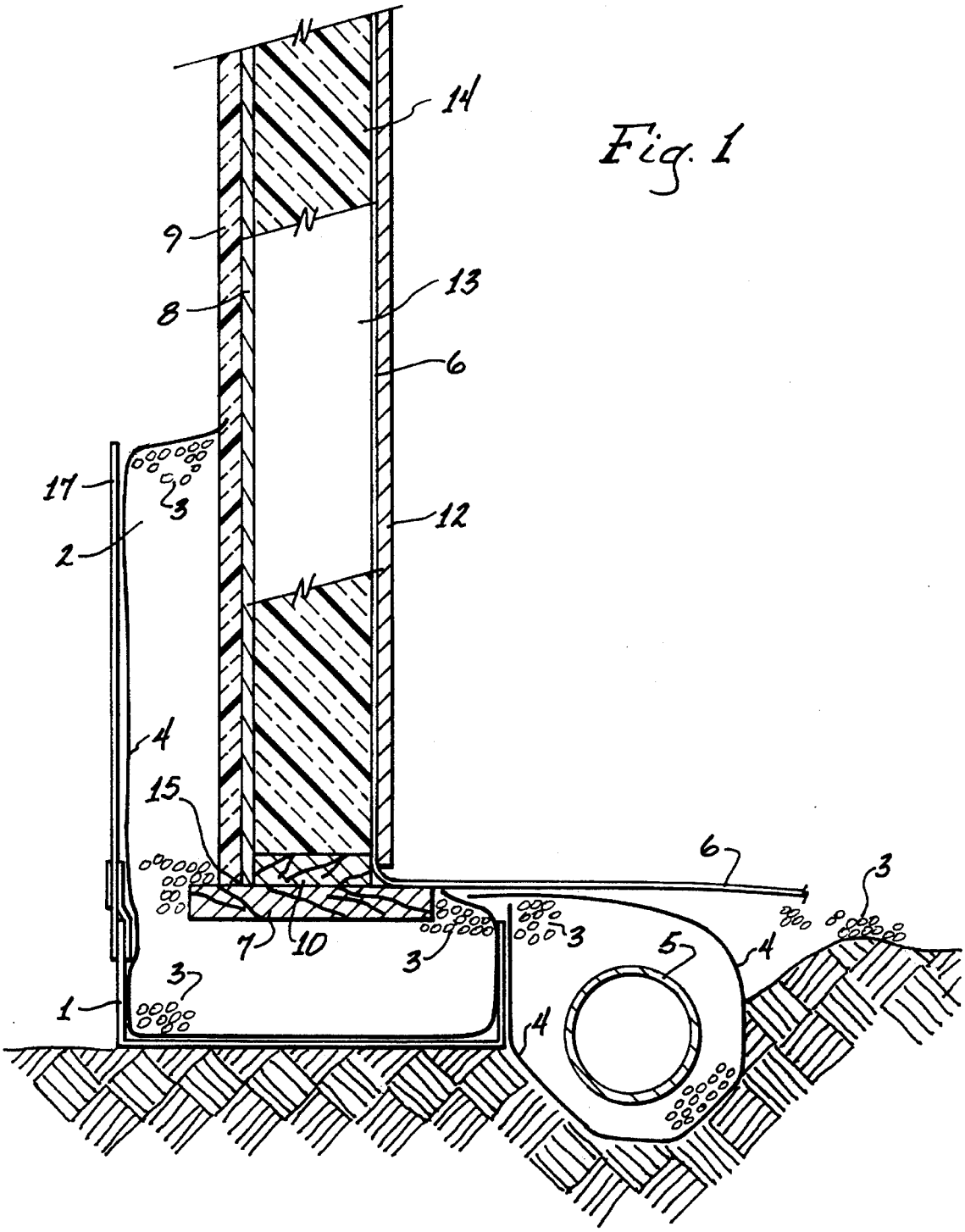
FIG. 1 is a plan side view of an embodiment of the present invention as installed in a foundation.

In FIG. 1 the drain system of this invention is illustrated in position in a building foundation. A steel, metal or rigid plastic-mesh retainer or basket 1 is placed in the ground so that its open end or face 2 allows crushed stone 3 to be placed therein. Before the crushed stone 3 is dumped therein a geotextile fabric 4 is lined inside the mesh retainer or/and on the outside so that it completely encloses the crushed stone 3. The porous geotextile fabric 4 which acts as an earth stabilizer and prevents sand and silt from entering the crushed stone 3. The entire crushed stone footer therefore acts as an integral part of the positive storm water drainage system of this invention, The geotextile fabric also enhances the load-bearing capacity of the footer by restraining the sub-grade soil and preventing it from entering the crushed stone 3. As earlier noted, the geotextile fabric is available from Typar Geotextiles and Rumay-Industrial Road P.O. Box 511, Old Hickory, Tenn. 37138. The stone retainer 1 confines the crushed stone to a given area adding structural strength; the crushed stone 3 is leveled and lightly tamped. As water enters the crushed stone 3 through the geotextile material 4 it is allowed to settle downwardly to a drain tile or other drainage means 5 where it flows to a sump pump or to the atmosphere. The fabricated stone retainer 1 provides drainage and is positioned to act as a part of the footer. A layer of porous crushed stone 3 covers the entire interior area of the excavation. The crushed stone thereby conducts any ground water to a positively drained sump (from either drain tile 5 or suitable materials such as HYDRAWAY 2000) preventing hydrostatic pressure on basement walls. The drain water is deflected downward through the crushed stone 3 drainage system by a polyethylene sheeting or vapor barrier 6 having a thickness of up to about 30 mils. In FIG. 1 a geotextile fabric 4 having a suitable permeability is shown which can contact the lower footer plate 7 and stone 3 so that the water directly enters into the storm drain 5. In FIG. 1 a plywood sheathing 8 rests vertically on a footer plate 7 around the entire periphery of the foundation. On the entire outerside of plywood sheathing 8 is placed a one inch or other suitable thickness rigid foam or other suitable insulation 9. The waterproof vapor barrier 6 is positioned under the interior floor or above the spread stone footer 3 and continues up the interior basement wall and is sandwiched between the wall insulation 14 and the panel or drywall 12. A sill plate 10 is positioned on top of footer plate 7 to form a hollow wall space 13 between an inner face 11 of the plywood sheathing 8 and the inner face of drywall 12 (or panelling or the like). The footer plate 7 and/or the sill plate 10 can be wrapped with a waterproofing membrane having a self-stick mastic adhesive. This would in effect provide a gasket between the sill plate 10 and footer 7 to prevent water damage. In this wall space 13 can be placed fiberglass insulation 14 (or other suitable insulation). An area of water collection and water damage is at the point 15 where the footer plate 7 meets the plywood sheathing 8 and could be caulked or otherwise further sealed. The waterproof barrier can be used to cover this location 15 to protect against water damage. Also, TRIMAX lumber can be used as the material for footer plate 7 to further enhance its water protection. TRIMAX lumber is available from Trimax Plastic Lumber, 2076 Fifth Avenue, Ronkonkoma, N.Y. 11779. TRIMAX is a trademark of Trimax Plastic Lumber.

Figure 2:
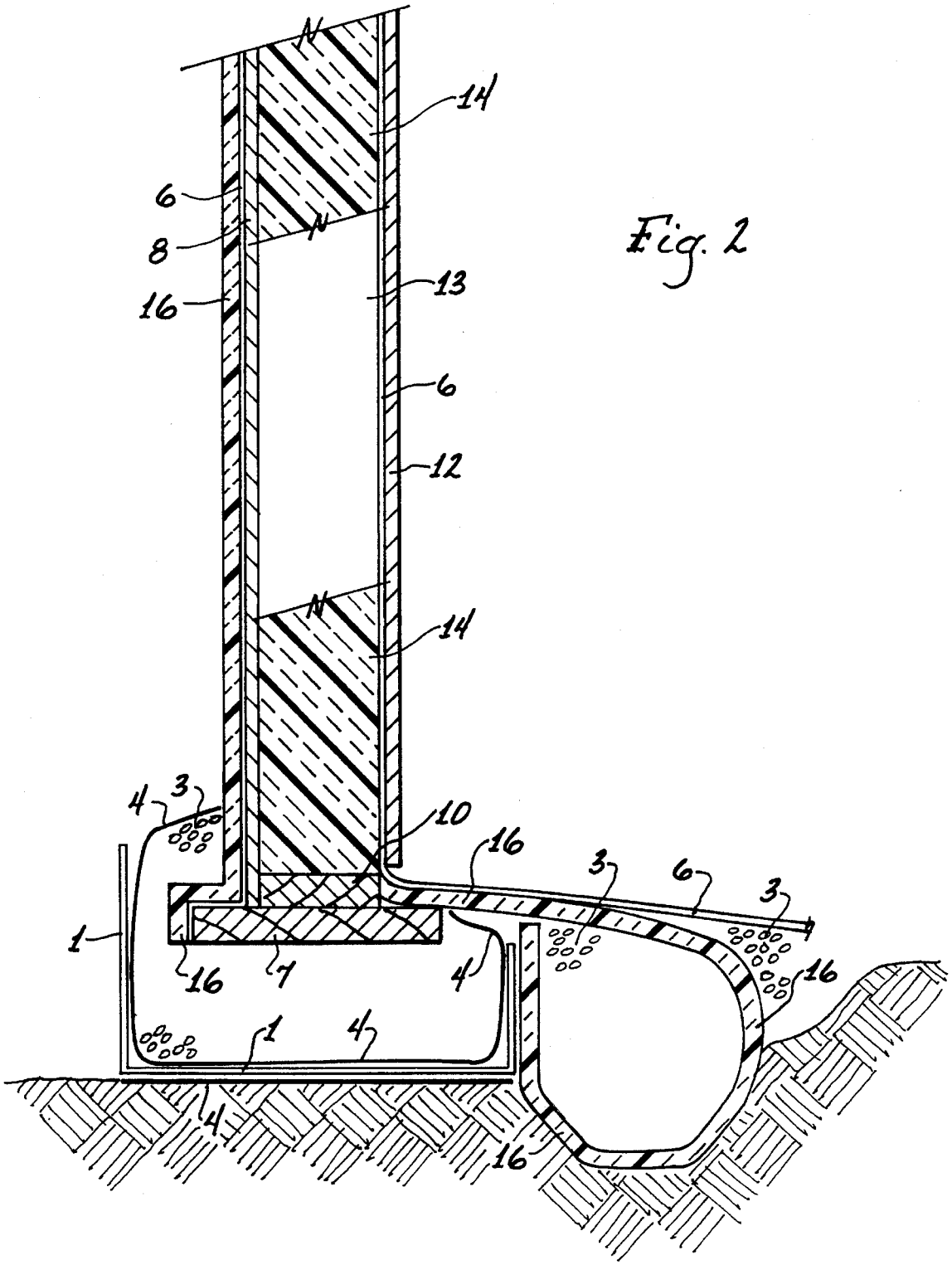
FIG. 2 is a plan side view of a second embodiment of the present invention as installed in a foundation.

In FIG. 2 the same system as in FIG. 1 is illustrated except that in place of insulation 9 and/or barrier 6, a material such as HYDRAWAY 300 is used. HYDRAWAY 16 consists of a solid backing that is waterproof and high strength polyethylene core that is fusion bonded to a polypropylene filter fabric. It has high compressive strength and flow capacity that will allow its use even in applications where soil loads are about 12,000 psf and the flow requirements are in excess of 10 gpm/ft-width. HYDRAWAY 2000 may be used around the crushed stone surrounding drain tile 5. HYDRAWAY® is a registered trademark of Monsanto Company, St. Louis, Mo. 63146. The primary advantages realized when using HYDRAWAY are superior performance and lower installed cost due to:

(1) HYDRAWAY 2000 replaces the fabric and perforated pipe required in most traditional drain systems.

(2) HYDRAWAY can be backfilled using the excavated trench material.

(3) HYDRAWAY can be machine installed using conventional trenching equipment.

(4) HYDRAWAY requires less labor and equipment than the traditional drain system.

Figure 3:
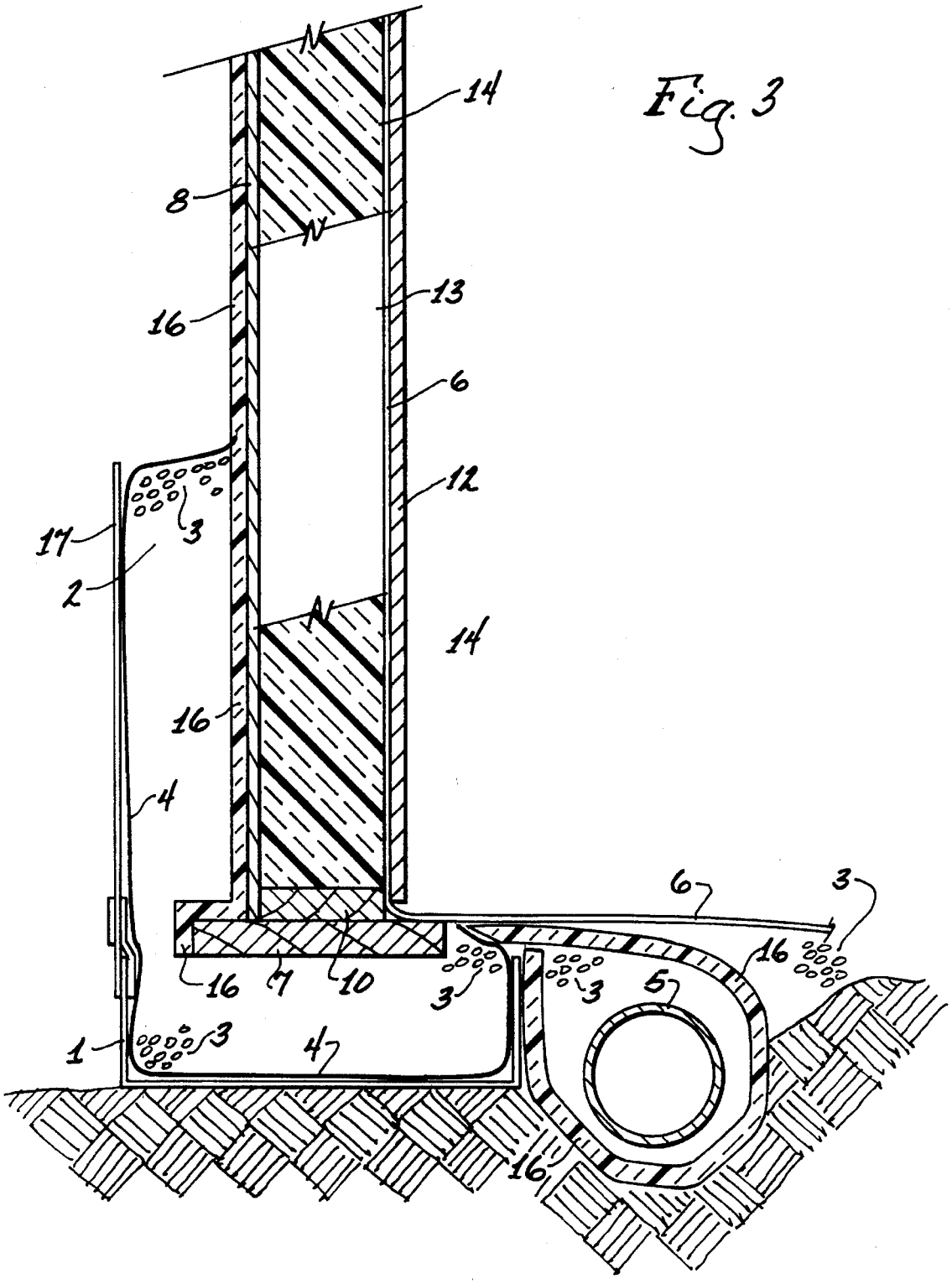
FIG. 3 is a plan side view of a third embodiment of the system of this invention as it is installed in a foundation.

Since the HYDRAWAY layer 16 is used, retainer 1 can be much shorter than in FIG. 1 since the HYDRAWAY layer 16 performs a similar water draining function and as an auxiliary means to the crushed stone 3 in the vertically-extended section 17 of retainer 1. Thus, the HYDRAWAY 300 layer 16 can be used in place of or together with retainer extension 17. FIG. 2 illustrates the HYDRAWAY layer 16 used in lieu of extension 17 and in FIG. 3, the HYDRAWAY layer 16 is illustrated when used with retainer extension 17. In FIG. 3 the HYDRAWAY 300 layer 16 is placed against the outside surface of plywood sheet 8 and together with the crushed stone 3 contained in retainer 1 acts to direct the subgrade water downwardly to the drain tile 5. Whenever the retainer 1 is used to house crushed stone 3, a geotextile fabric 4 lines the retainer. Geotextile fabric 4 also surrounds the crushed stone 3 positioned around drain tile or other drain means 5. The HYDRAWAY layer 16 may be also used around drain tile 5 if desirable.

Figure 4:
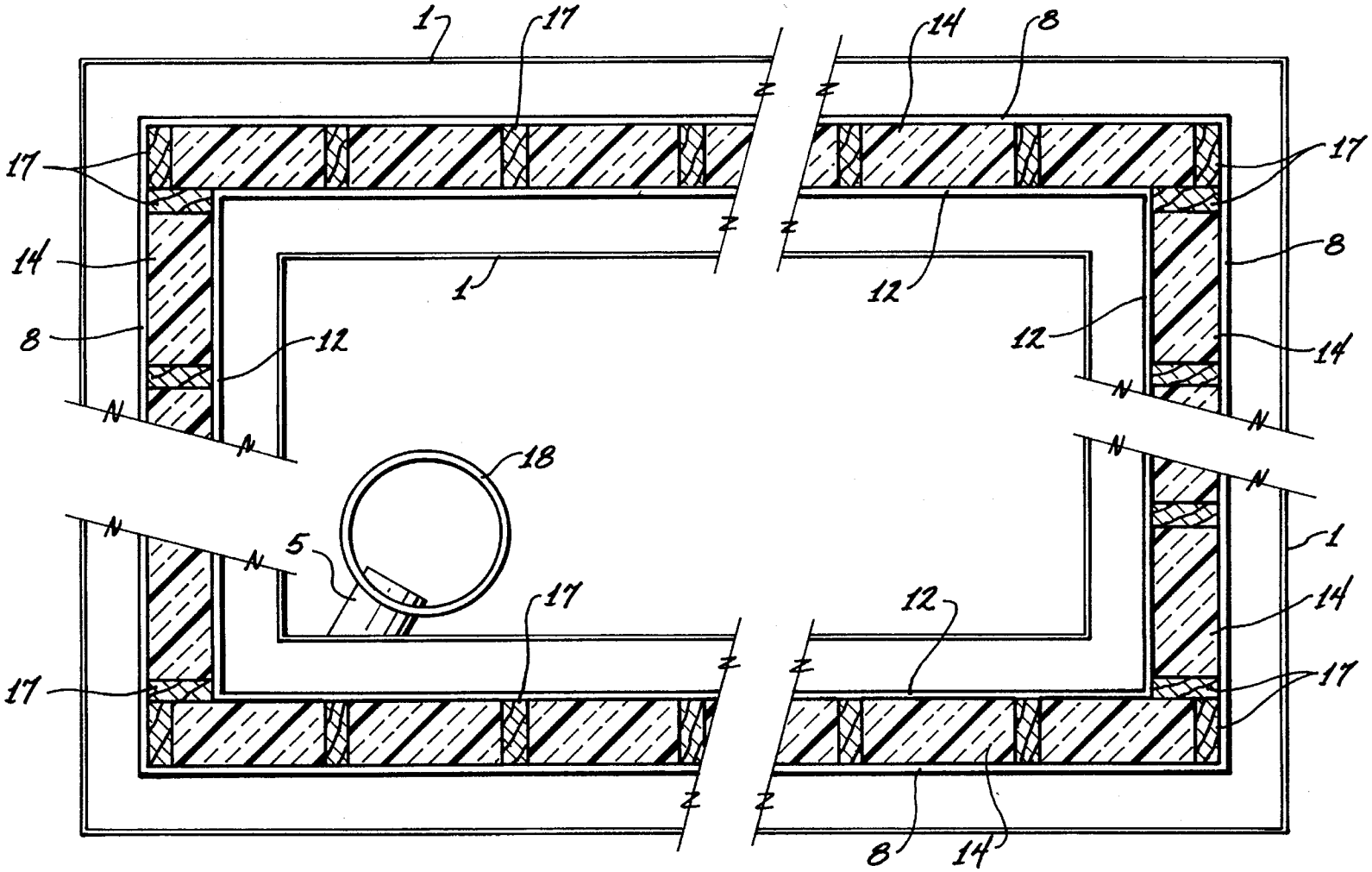
FIG. 4 plan top view of the drainage system of this invention as used in a building foundation.

FIG. 4 is a top plan view of the entire foundation for a house or other building having the retainer 1 in its U shape extending up an outside wall of plywood sheathing 8 and up an inside lower portion of drywall or panelling or other finished inner wall 12. The retainer contains the crushed stone 3 and/or HYDRAWAY layer 16 as illustrated in FIGS. 1, 2 and 3. Between the drywall 12 and plywood sheathing 8 are the usual studs 17 and insulation 14. The drain tile 5 would be located in the conventional area surrounding or parallel with the foundation to a sump pump or sewer drain 18 located either both on the inside of the foundation or on the outside.

Figure 5:
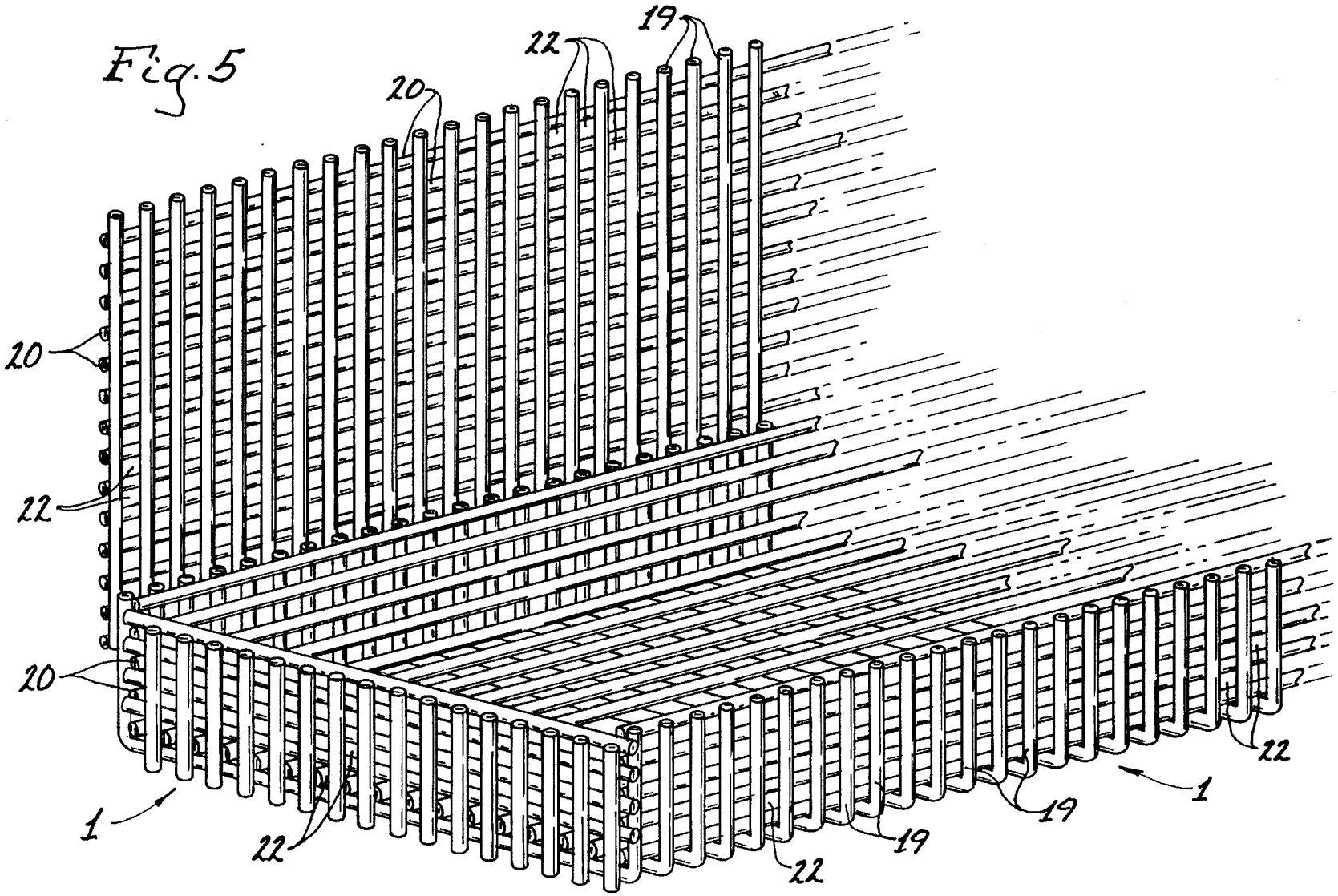
FIG. 5 is a perspective view of the mesh basket or retainer used in the system of this invention.

FIG. 5 is a perspective view of the retainer 1 used in the present invention. As earlier noted, any suitable porous retainer can be used in place of the steel mesh. In one embodiment the retainer 1 is made up of steel mesh having disecting horizontal 19 and vertically 20 disposed wire. The retainer or basket 1 has side structures 21 which prevent the side escape of crushed stone therefrom. The basket 1 is either U-shaped or L-shaped depending upon the desired extension of vertical section 17 up the plywood 8. The apertures 22 formed by wires 19 and 20 are smaller than the individual stone therein to prevent escape from the basket interior. Wire mesh screens of the type disclosed in U.S. Pat. No. 4,686,342 may be used as may any other suitable mesh. High carbon steel mesh is preferred because of its hardness, high resistance to wear and for its long working life. As noted earlier in this disclosure, the retainer basket 1 is always lined with a geotextile material 4 to prevent sediment, sand or silt from entering the crushed stone mixture and rendering the stone less water permeable. The crushed stone 3 must always permit the free flow of water therethrough for the present system to be effective.

In summary, the novel drain system of this invention permits permanent wood foundations to be used with a much improved degree of success than heretofore. Rather than allowing water to accumulate along a concrete block permanent wood foundation or poured concrete foundation, the system of this invention allows the subsurface water to flow through contained crushed stone absent silt and sand to a drain tile thereby removing subsurface water problems along a building foundation. While this system can be used with concrete foundations, it is specifically designed and suited for permanent wood foundations. It provides a moisture-proof basement with the properties of above ground room.

The preferred and optimumly preferred embodiments of the present invention have been described herein and shown in the accompanying drawings to illustrate the underlying principles of the invention, but it is to be understood that numerous modifications and ramifications may be made without departing from the spirit and scope of this invention.

What is claimed is:

1. A water drain system for building foundations which comprises in combination a vertically-disposed foundation, a crushed stone retainer adjacent said foundation, a drain tile network and a waterproof barrier covering substantially all exposed outside surfaces of said foundation, said barrier positioned between said retainer and said foundation, said retainer containing in substantially all of its inner volume crushed stone, a water-permeable membrane in contact with all sides, bottom and top exposed portions of said retainer, said water-permeable membrane surrounding said drain tile with crushed stone positioned between said membrane and said drain tile, said crushed stone in said retainer and around said drain tile forming a water-draining conduit with means to allow any subsurface water to drain through said crushed stone to said drain tile and out to a water drain sump or network, and wherein said retainer is a mesh material forming apertures therein having dimensions smaller than substantially all of said crushed stone.

2. The system of claim 1 wherein said foundation is a permanent wood foundation.

3. The system of claim 1 wherein said porous material is a geotextile fabric.

4. The system of claim 1 wherein said waterproofing material is a material selected from the group consisting of rubber and, plastic said waterproofing material having a thickness of at least 30 mils.

5. The system of claim 1 wherein said foundation is a wood foundation having a thickness of at least ⅜ inch.

6. The system of claim 1 wherein said retainer is a mesh metallic material forming apertures therein having dimensions smaller than substantially all of said crushed stone.

7. The system of claim 1 wherein said foundation rests upon a footer plate made of lumber.

8. The system of claim 1 wherein together with said barrier a sheeting is used.

* * * * *